United States Patent [19]

Granger

[11] Patent Number: 5,065,924

[45] Date of Patent: Nov. 19, 1991

[54] PAPER TOWEL DISPENSER WITH CENTRAL UNWINDING

[76] Inventor: Maurice Granger, 17 Rue Marcel Pagnol, 42270 Saint Priest en Jarez, France

[21] Appl. No.: 623,217

[22] Filed: Dec. 6, 1990

[30] Foreign Application Priority Data

Nov. 6, 1990 [FR] France ..... 90 14094

[51] Int. Cl.[5] ..... B26F 3/02

[52] U.S. Cl. ..... 225/46; 225/42; 225/51; 225/53; 225/79; 225/82

[58] Field of Search ..... 225/39, 46, 51, 52, 225/53, 47, 25, 27, 42, 72, 73, 79, 82

[56] References Cited

U.S. PATENT DOCUMENTS

| | | | |
|---|---|---|---|
| 1,185,490 | 5/1916 | Everhart | 225/52 |
| 1,415,722 | 5/1922 | Silverman | 225/47 |
| 2,211,210 | 8/1940 | Johnson | 225/51 |
| 2,382,659 | 8/1945 | Olson | 225/42 |
| 3,923,223 | 12/1975 | Larsson et al. | 225/46 |
| 4,524,895 | 6/1985 | Lunden | 225/19 |
| 4,760,970 | 8/1988 | Larsson et al. | 242/55.54 |
| 4,919,350 | 4/1990 | Miller | 242/55.2 |

*Primary Examiner*—Frank T. Yost
*Assistant Examiner*—John M. Husar
*Attorney, Agent, or Firm*—Parkhurst, Wendel & Rossi

[57] ABSTRACT

A dispenser comprising a casing (1) of a general internal cylindrical form with a bottom wall (1*a*) for fixing (1*b*) to any support surface and a front wall forming a loading door (2), the latter being provided with an axial opening (2*f*) for the passage and outlet of a strip (R) of material unwound from the inside and separated by a cutting device (12) associated to the opening, the strip coming from a roll of material (R) positioned in the casing with its horizontal axis of symmetry, the roll of material, regardless of its degree of use, being retained without any risk of deformation and collapsing at the end of unwinding, by one or several devices associated to the casing acting by applying pressure to all or part of the sides of the roll.

15 Claims, 4 Drawing Sheets

S
1c
1
S1
1b
1a
1e
1d
4
4b
4a
6
5
5a
2a
3
2f
12
2
2g
2d
2b
2c
R
R1

FIG.4
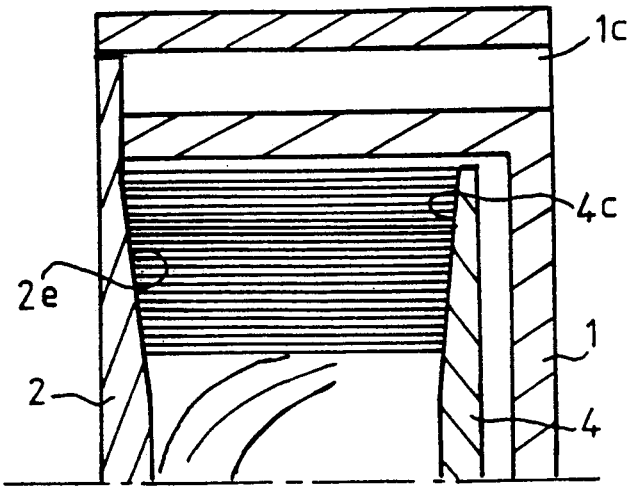
FIG.5
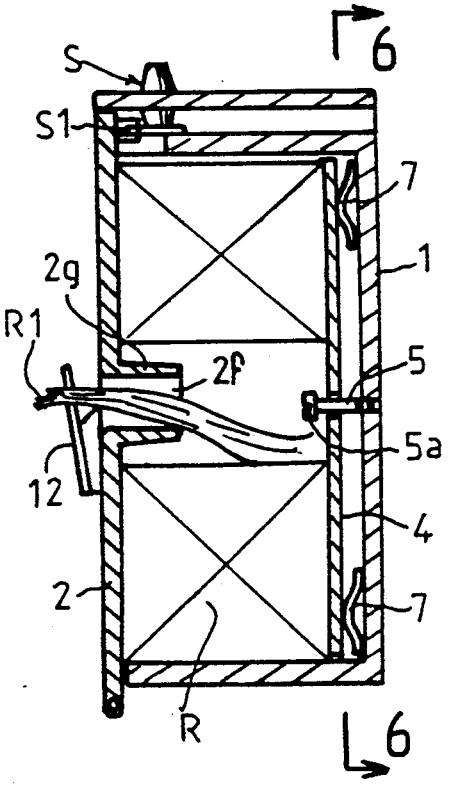
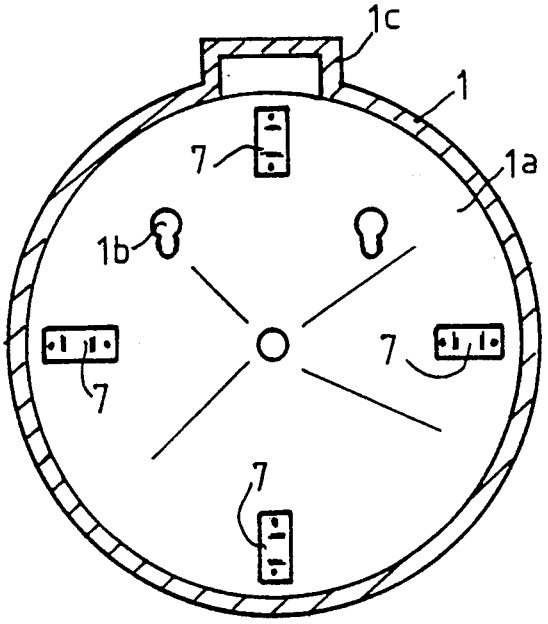
FIG.6

PAPER TOWEL DISPENSER WITH CENTRAL UNWINDING

BACKGROUND OF THE INVENTION

The object of the invention is related to the technical sector of means to dispense lengths of paper, wadded paper and other products, wound up in rolls. Simplified dispensers with central unwindings are known, wherein the roll of paper towels is arranged with its vertical axis of symmetry on a bottom plate of the dispenser, the said bottom being provided with a central opening enabling the passage and outlet of a strip by central unwinding under the pulling action by a user. The strip pulled vertically, is then separated by angular orientation against a fixed cutting component, after the central opening and providing the separation by tearing.

This type of unit has certain disadvantages. Firstly, it requires a lot of space in the horizontal direction, particularly when rolls of paper towels with a large diameter are to be used, in order to have a large stock. Therefore, this calls for the production of bulky and often unattractive units, with complicated shapes with regard to the wall support, roll holder plate and casing or cover. With this in mind, these units are relatively expensive to produce and go against the aim sought after, i.e: to economically outfit a maximum number of public places with this type of unit.

Secondly, the central unwinding of the material in helical form provokes substantial twisting and creasing. Consequently, a very uneven bevel type cut against the cutting component results from improper tearing of the material in the unit under a sudden pulling effect. This leads to placing the dispenser out of order. It is important to point out that the unit consumes a lot more paper than is actually required, leading to substantial waste; one of the major disadvantages of this type of dispenser. Due to the vertical positioning of the center line of the roll, the vertical pulling of the strip is facilitated so that there is no particular resistance before angular orientation in order to carry out the cut.

Furthermore, the fact that the strip of material is very thin and the roll must be stable regardless of its situation of use and consumption, must be taken into account.

SUMMARY OF THE INVENTION

One of the aims of the invention is to produce a paper towel dispenser with central unwinding which is compact with a simple shape and inexpensive to produce even with rolls of large diameters.

Another aim is to produce a dispenser which considerably reduces or limits the waste of strips of material pulled.

These aims and others shall be made well apparent from the following description.

According to a first characteristic, the dispenser comprises a casing with a bottom wall to be fixed to any support surface and a front wall forming a loading door, this being provided with an axial opening for the passage and outlet of a strip of material unwound from the inside and separated by a cutting device associated with the opening. The strip pulled comes from a roll of material positioned in the casing with its horizontal axis of symmetry, the roll of material being retained regardless of its degree of use without any risk of deformation and collapsing. One or several means associated to the casing apply pressure against the sides of the roll.

According to another characteristic, the means for cooperation between the roll and casing of the dispenser with a view to retaining the roll, without deformation or collapsing, comprises fixtures inside the casing of the dispenser. The fixtures comprise, in front of the bottom wall, an intermediate positioning plate, against which the adjustable roll is applied against elastic return means. The intermediate plate constantly presses the roll against the front wall, which turn a door when in a closed position.

According to another characteristic, the cooperation means between the roll and casing of the dispenser with a view to retaining the roll without deformation or collapsing, comprises fixtures of the roll of material, which take, on its periphery and laterally, one or several adhesive surfaces designed to cooperate closely with the casing of the dispenser, at least on the top part.

According to another characteristic complementary to the previous one, such adhesive surfaces have, on the width of the roll, a free tongue, to be engaged and retained in a recess of the casing.

Another aim of the invention is to dispense strips of material which are not creased and have the correct appearance.

With this in mind, according to another characteristic, the axial opening for the passage and outlet of the strip of material has a chimney inside the door, provided to straighten the material previously put into helical form and creased by central unwinding.

Therefore, according to the invention, the dispenser, provides, in a novel way, a different arrangement of the roll with central unwinding, in a position with a horizontal axis, without there being any collapsing of the material even at the end of the roll. In contrast, the prior art, to date has rolls were always positioned on a vertical axis.

These characteristics and others will be made apparent from the following description.

In order to clarify the object of the invention, without limiting it, the invention is illustrated by the accompanying drawings:

BRIEF DESCRIPTION OF THE DRAWINGS

FIG. 4 is a partial section illustrating an alternative embodiment of the lateral retainer of the roll of material.

FIG. 5 is a side section of the dispenser according to an alternative embodiment.

FIG. 6 is a section taken along line 6—6 of FIG. 5.

DESCRIPTION OF THE PREFERRED EMBODIMENTS

For the purpose of clarification, the invention shall now be described in a non-limited manner when considered in conjunction with the accompanying drawings.

Figure 1:
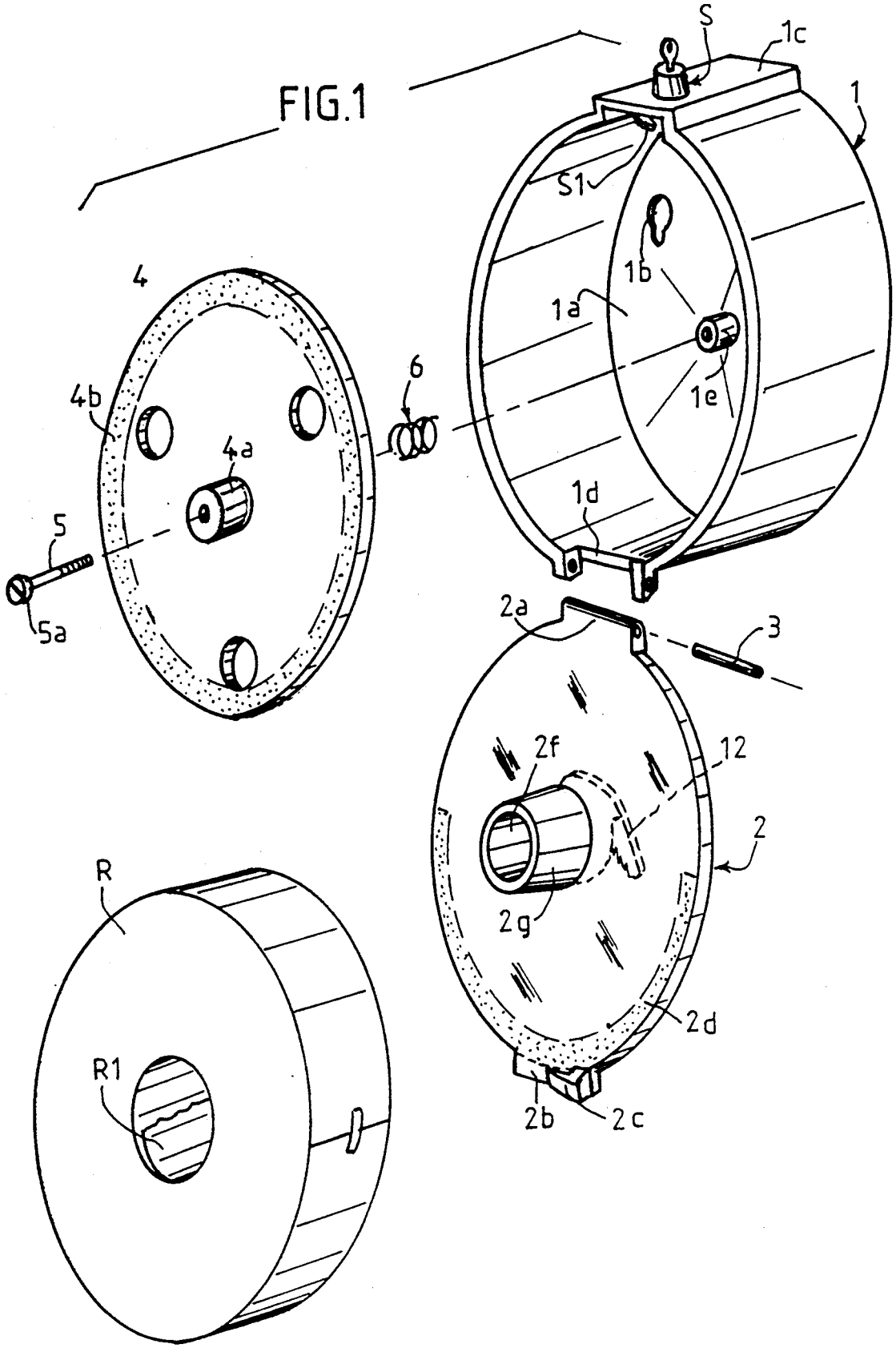
FIG. 1 is a perspective view separately illustrating the main components of the dispenser according to the invention in a first embodiment.
Figure 2:
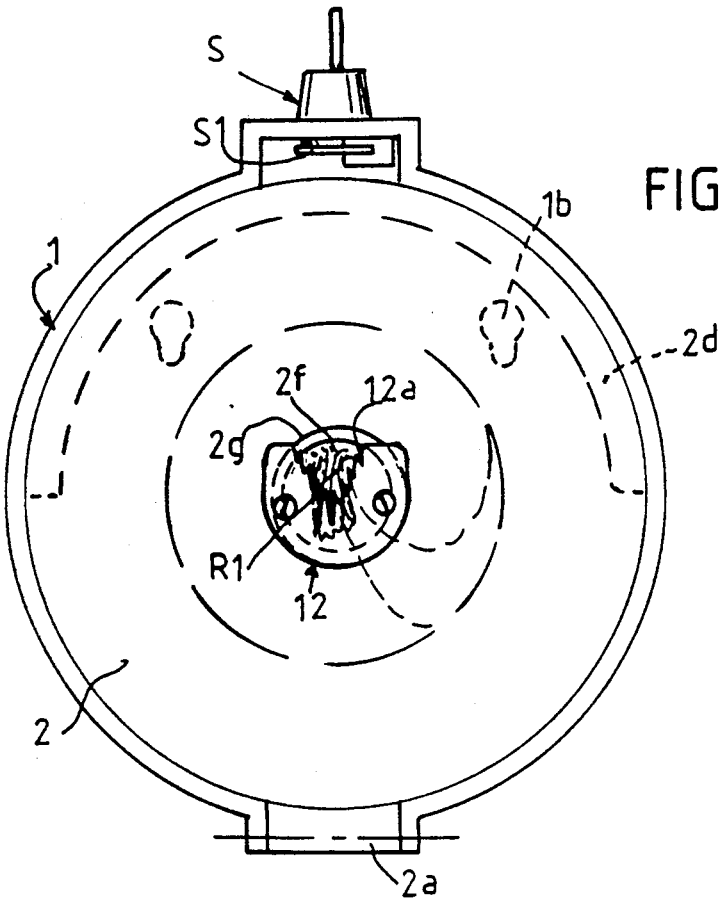
FIG. 2 is a front view of the dispenser according to FIG. 1.

The dispenser illustrated particularly in FIG. 1, comprises a casing (1) of a general cylindrical shape, the diameter and depth of which are determined in order for a roll of material (R) of slightly smaller dimensions to be housed inside. The bottom wall (1*a*) of the casing has fixing points of the button hole type (1*b*) for example, to be connected to any surface. Other forms of fixing can be envisaged while remaining within the framework of the invention. The top part of the casing forms a recess (1*c*) designed to take a locking component of the lock (S) type for a front wall forming a loading door (2). This is hinged in (2*a*) by a pin (3) in a recess (1*d*) diametrically opposed to the recess (1*c*), and whose projecting part (2*b*) diametrically opposed to the hinged part (2*a*), has a component (2*c*) complementary to the hook (S1) of the lock. The door has, in an axial manner, an opening (2*f*) for the passage and outlet of the strip of material (R1) unwound from inside the roll.

According to characteristics of the invention, the dispenser should enable the roll of material (R) to be retained, thereby positioned with its horizontal axis of symmetry without the risk of deformation and collapsing, particularly when the roll is only a thin annulus of material or coils to be unwound from the inside.

For this purpose and according to a first embodiment illustrated in FIGS. 1 to 6, an intermediate circular plate (4) is housed with play, in the casing and connected to the bottom wall (1*a*), with the possibility of limited movement against elastic return means towards the front.

For example, the plate (4), has, in an axial manner, a recess (4*a*) designed to partially cover an axial pin (1*e*) of the bottom wall. The plate (4) and bottom wall (1*a*) are therefore integral, for example, to an axial screw (5) with enlarged head (5*a*) crossing the recess (4*a*) and being screwed into a tapped hole of pin (1*e*). A helical spring (6) is inserted between the recess (4*a*) and bottom wall in order to constantly push the plate (4) against the roll (R) which is therefore clamped against the door (2) in a closed and locked position.

Figure 3:
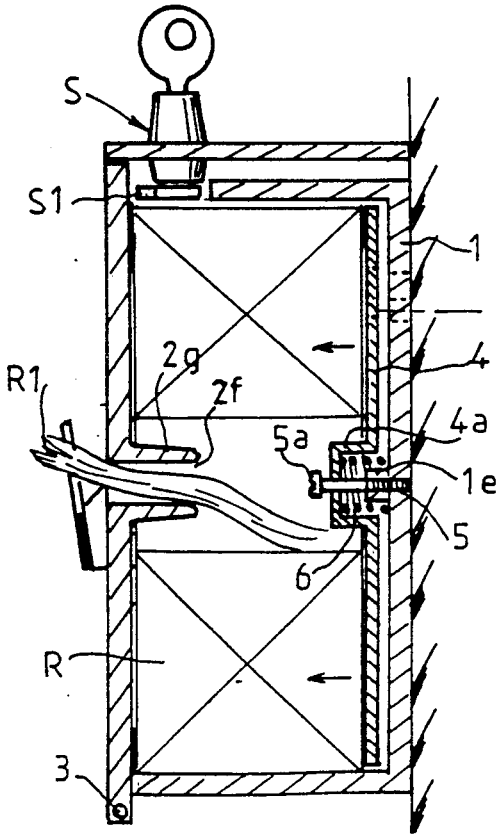
FIG. 3 is a side section of the dispenser according to FIG. 1.

Other means of connection between the plate and bottom wall can be used. In order to enhance the retaining effect of the roll, when only a small quantity of coils is left to be unwound, additional lateral retainers are provided, for example, as illustrated in FIGS. 1 and 3 thereby making the surfaces opposite the plate (4) and door (2) rough by any means such as grooving, and multi-projections, at least in the form of a semi-annulus (2*d*–4*b*) corresponding to the top part of the roll (R).

As an alternative, as illustrated in FIG. 4, the faces opposite the door (2) and plate (4), can be provided with zones (2*e*) and (4*c*) sloped towards the periphery in order to retain the roll.

According to another alternative illustrated in FIGS. 5 and 6, the elastic pressure of the plate (4) against the wall (2) is obtained by spring steel type blades (7) regularly distributed throughout the bottom wall (1*a*) or by elastic tongues obtained directly from moulding and also regularly distributed.

Figure 7:
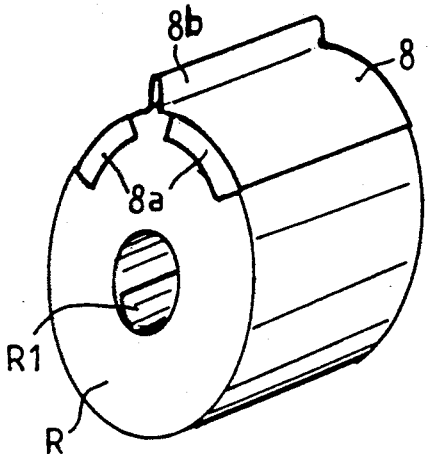
FIG. 7 is a perspective view illustrating a roll of material fitted with retaining means in the casing according to another embodiment.
Figure 8:
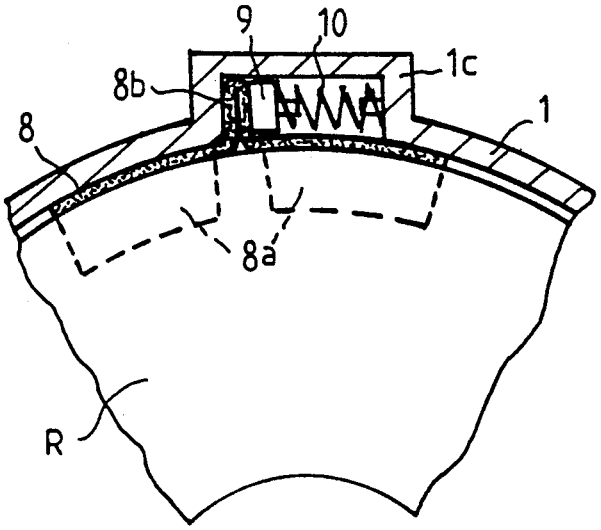
FIG. 8 is a partial section on a larger scale, illustrating the roll according to FIG. 7, retained in the casing of the dispenser.

The top and lateral retainer of the roll of material (R) can be obtained by the arrangement of the roll itself in order to create zones of cooperation between the roll and casing. For example, as shown in FIGS. 7 and 8, the periphery of the roll (R) can take an adhesive strip (8) applied over the whole width of the roll and laterally by flaps (8*a*) extending over a limited height in the direction of the center of the roll.

The middle part of the strip (8) forms a free tongue (8*b*) designed to cooperate with the casing.

For this purpose, the tongue may have an adhesive face to be applied against a lateral face of the recess (1*c*) of the casing. Alternatively, as illustrated, the tongue is maintained against the face by a bar (9) urged by the action of an elastic component (10).

Figure 9:
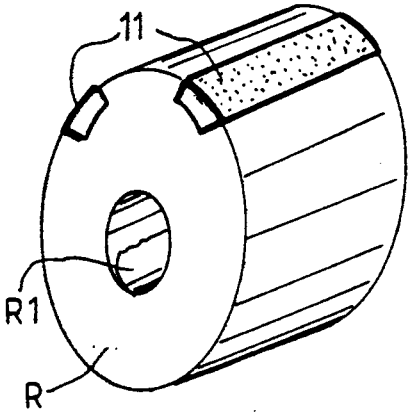
FIG. 9 is a perspective view illustrating a roll fitted with retaining means in the casing according to another embodiment.
Figure 10:
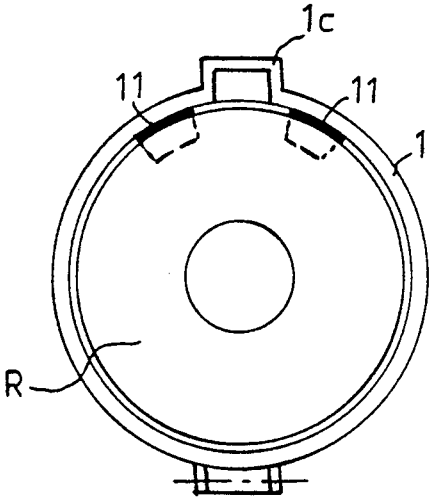
FIG. 10 is a front view illustrating the roll according to FIG. 9, retained in the casing of the dispenser.

According to the alternative illustration in FIGS. 9 and 10, the roll (R) takes, on its periphery and laterally, at least two strips (11) of double-sided adhesive type.

In this case after removing a protective film, the roll (R), only has to be inserted into the casing and the strips (11) applied against the internal wall of the casing at the top part in order to retain the roll which may also be retained by adhesive side flaps against the door and bottom wall.

The retaining capacity of the spring loaded bar or the self-adhesive power of the strips is determined so that at the end of unwinding, they can be separated or freed by simple pulling on the last strip.

In a complementary manner, the door (2) has, in an axial manner, an opening (2*f*) formed in a chimney (2*g*) extending inside over a limited depth and dimensioned so as to pass through the central recess of the roll.

This chimney is provided to straighten the material unwound in helical form and therefore present it non-creased and easily unfoldable.

Finally, a cutting component by tearing is provided outside the door. For example, this component can be a plate (12) fixed by any means onto the door and extending, preferably in a sloped manner (angle $\alpha$, FIG. 3) with respect to the door and exceeding the center line of the opening (2*f*) in order to prevent any objects or scraps in the dispenser from being introduced.

The top part of the plate (12) has a notch (12*a*) providing the tearing by manual pulling under a different angle to the outlet angle.

It is also noted that the chimney (2*g*) can be mounted to freely rotate on the door and the cutting component (12).

This plate can be mounted so as to turn on the front wall to enable a cut according to the angular orientation applied when the paper is pulled.

Although the advantages of the invention are clearly apparent from the preceding description, the following is highlighted again: the simplified, therefore economical production of the dispenser; the positioning of the roll of material with its horizontal axis of symmetry enabling the dimensions of the dispenser to be limited (without, however, excluding the possibility of fixing the dispenser horizontally); the dispensing of adhesive strips of material due to the straightening device; and the elimination of waste by locking the roll of material between the two surfaces under pressure.

I claim:

1. An apparatus for dispensing a static roll of paper, wherein said roll is unwound from a central axis to an outer periphery thereof, said apparatus comprising:

a hollow cylindrical casing for housing said roll such that a central axis of said casing and the axis of said roll are oriented horizontally, said casing comprising:

(i) a back wall having means for attachment to a support surface; and (ii) a front wall having an opening formed therein which is aligned with the axis of said roll, said opening enabling passage through said front wall of a helical strip of paper unwound from said roll;

means for applying constant pressure to substantially an entire end surface of said roll such that said roll is retained in said casing without deformation or collapse; and means associated with said opening for cutting said strip into segments.

2. The apparatus of claim 1, further comprising a chimney axially disposed over said opening on an exterior surface of said front wall, for guiding and straightening said strip of paper pulled therethrough.

3. The apparatus of claim 1, wherein said pressure means comprises: an intermediate plate positioned in a plane which is substantially parallel to said back wall, said plate being disposed between said roll and said back wall; and elastic means for applying constant pressure to said plate against said front wall.

4. The apparatus of claim 1, wherein said plate and said front wall comprise rough, at least semi-annular surfaces formed on interior faces thereof.

5. The apparatus of claim 1, wherein interior surfaces of said plate and said front wall comprise portions which are sloped in a radial direction towards respective outer surfaces thereof.

6. The apparatus of claim 1, wherein said plate is connected to said back wall so as to have limited movement in a direction of the axis of said roll, and said elastic means is disposed between said back wall and said plate.

7. The apparatus of claim 6, wherein said plate includes a central axial recess and said back wall includes a central axial pin aligned with said recess, said elastic means comprising a helical spring which is housed in said axial recess so as to surround said axial pin.

8. The apparatus of claim 6, wherein said elastic means comprises spring steel blades which are regularly distributed on said back wall.

9. The apparatus of claim 6, wherein said elastic means comprises elastic tongues which are directly molded and regularly distributed on said back wall.

10. The apparatus of claim 1, wherein said cutting means comprises a plate which is disposed in a sloped manner on an exterior surface of said front wall, said plate having saw-toothed notches for tearing said strip of paper.

11. The apparatus of claim 10, wherein said chimney and/or said cutting means are freely, rotatably mounted to said front wall.

12. An apparatus for dispensing a static roll of paper, wherein said roll is unwound from a central axis to an outer periphery thereof, said apparatus comprising:

a hollow cylindrical casing for housing said roll such that a central axis of said casing and the axis of said roll are oriented horizontally, said casing comprising:

(i) a back wall having means for attachment to a support surface; and (ii) a front wall having an opening formed therein which is aligned with the axis of said roll, said opening enabling passage through said front wall of a helical strip of paper unwound from said roll;

means comprising adhesive surfaces disposed on the end surfaces and on the cylindrical peripheral surface of said roll for retaining said roll in said casing without deformation or collapse; and means associated with said opening for cutting said strip into segments.

13. The apparatus of claim 12, wherein said casing comprises a recess disposed on the cylindrical peripheral surface and along a direction of the axis thereof, and at least one of the peripheral adhesive surfaces comprises a tongue which is inserted into said recess for retaining said roll in a fixed position.

14. The apparatus of claim 13, wherein said tongue is retained in said recess by adhering an adjacent one of said adhesive surfaces to the cylindrical peripheral surface of said casing.

15. The apparatus of claim 13, further comprising elastic means disposed in said recess for retaining said tongue therein.

* * * * *